US008042608B2

(12) United States Patent
Baker

(10) Patent No.: US 8,042,608 B2
(45) Date of Patent: Oct. 25, 2011

(54) HEAT EXCHANGER

(76) Inventor: Benjamin Paul Baker, Campbelltown (AU)

( * ) Notice: Subject to any disclaimer, the term of this patent is extended or adjusted under 35 U.S.C. 154(b) by 975 days.

(21) Appl. No.: 11/867,957

(22) Filed: Oct. 5, 2007

(65) Prior Publication Data

US 2008/0149317 A1 Jun. 26, 2008

Related U.S. Application Data

(63) Continuation-in-part of application No. PCT/AU2006/000459, filed on Apr. 7, 2005.

(30) Foreign Application Priority Data

Apr. 7, 2005 (AU) ..... 2005901721

(51) Int. Cl.
*F28D 7/02* (2006.01)

(52) U.S. Cl. ..... 165/165

(58) Field of Classification Search ..... 165/160, 165/161, 163, DIG. 401, DIG. 405, DIG. 418
See application file for complete search history.

(56) References Cited

U.S. PATENT DOCUMENTS

| | | | | |
|---|---|---|---|---|
| 1,893,484 | A | 1/1933 | Belt | |
| 4,644,906 | A | 2/1987 | Garabedian et al. | |
| 4,739,634 | A | 4/1988 | Watanabe | |
| 5,309,987 | A | 5/1994 | Carlson | |
| 6,047,767 | A * | 4/2000 | Bodhaine et al. | 165/141 |
| 6,499,534 | B1 | 12/2002 | Tawney et al. | |
| 2003/0094268 | A1 | 5/2003 | Ohira et al. | |
| 2004/0154312 | A1 | 8/2004 | Abras | |

FOREIGN PATENT DOCUMENTS

| | | |
|---|---|---|
| AU | 79 047/81 | 6/1983 |
| AU | 200234307 | 10/2003 |
| DE | 1 551 498 | 4/1970 |
| DE | 2 147 909 | 3/1973 |
| DE | 27 08 377 | 8/1978 |
| EP | 1 431 690 | 6/2004 |
| EP | 1 460 365 | 9/2004 |
| JP | 53-36756 | 12/1993 |

(Continued)

*Primary Examiner* — Teresa Walberg
(74) *Attorney, Agent, or Firm* — Michael J. Striker

(57) ABSTRACT

A heat exchanger (10) has an outer housing (16) and a first helical fluid flow path or coil (12) located in the housing (16) defining a plurality of turns and having an inlet (24) and an outlet (22) for entry and exit of fluid into the flow path to be heated or cooled. A second helical coil (14) defining a second fluid flow path is located within the housing (16) adjacent to the first coil. The second coil also has an inlet (24) and outlet (22) for a passage for hot or cold service media. A conductive or non-conductive sheath (18) is disposed between the coils. A transfer medium is disposed in the housing for transfer of heat between the first and second flow paths. A plurality of baffles (20) are located between the outer housing and sheath and disposed between turns of the first coil. A plurality of baffles (21) are also disposed between turns of the second coil (14). By interposing a transfer medium between the two fluid flow paths rather than having one of the fluid flows as the medium itself, control over the cooling or heating of the fluid to be heated or cooled is possible. The fluid being cooled or heated and fluid transfer medium may be at different temperatures. The sheath (18) and baffles (20, 21) help control the transfer of heat and improve the efficiency of the heat exchanger.

13 Claims, 4 Drawing Sheets

FOREIGN PATENT DOCUMENTS

| | | |
|---|---|---|
| JP | 2002-147976 | 5/2002 |
| SU | 1010436 | 4/1983 |
| WO | 95/21365 | 8/1995 |
| WO | 98/51611 | 11/1998 |
| WO | 98/51982 | 11/1998 |
| WO | 03/098138 | 11/2003 |

* cited by examiner

HEAT EXCHANGER

CROSS-REFERENCE TO RELATED APPLICATIONS

The present application in a Continuation-in-Part of International patent Application No PCT/AU2006/000459 which claims priority from Australian Provisional Patent 2005901721 filed on 7 Apr. 2005, the contents of both specifications being incorporated herein by reference.

FIELD OF THE INVENTION

This Invention relates to heat exchangers and, in particular, to improvements in the control of heat exchangers, particularly to heat exchangers for liquid or gaseous heat exchange to fluids. In more particular aspects, the invention is concerned with heat exchangers for cooling liquids, particularly beverages such as beer or soft drinks, although the principals of the invention could equally be applied to heating, or cooling, other fluids.

BACKGROUND OF THE INVENTION

Heat exchangers are commonly used in clubs, bars, hotels and other venues to chill beverages, typically, from a temperature of around 20° to 30° C. to around 0° C. for sale to patrons. Such heat exchangers are usually installed under a traditional bench or bar top.

Existing technology for cooling beverages, such as beer, prior to dispensing from a tap, tends to be relatively large and consequently, rather expensive. Many of the larger cooling installations are set up to chill numerous lines of beer prior to dispensing it from one of a number of taps, but also typically chill a number of glass cabinets for pre-chilling the glasses into which beverages are dispensed.

There is a need for a low cost compact system for dispensing beverages for smaller venues such as restaurants which may sell only one or two different beverages and will only require one or more chilling and dispensing lines. The existing installations which are used in pubs, clubs and hotels are all too large and expensive.

One further problem with dispensing beverages, such as beer from a tap, is that the beverage companies such as brewers and soft drink manufacturers, often require their beverages to be dispensed at a particular temperature or within a particular range of temperatures. For example beers, are typically required to be sold at a temperature of between 2 and 4° C. inside the glass which means that the beer has be dispensed from the tap in a hotel at around 0.5 to 1° C. to allow for the heat capacity of the glass which will typically be at a temperature of greater than 4° C. The dispensing temperature of 0.5 to 1° C. is approaching the freezing temperature for beer and if a beer tap is little used and the beer over chilled, there is a risk that the beer will freeze in the pipes of the dispensing apparatus. At the same time, the dispensing apparatus must be sufficiently efficient to be able to dispense beer at the correct temperature as prescribed by the beverage company and on demand.

The present invention aims to address or alleviate at least some of the problems of the prior art discussed above.

The present invention also aims to apply any solutions to the problems discussed above to other fields where heat exchangers are or may be utilised.

Any discussion of documents, act, materials, devices, articles or the like which has been included in the present specification is solely for the purpose of providing a context for the present invention. It is not be taken as an admission that any or all of these matters form part of the prior art base or were common general knowledge in the field relevant to the present invention as it existed before the priority date of each claim of this application.

SUMMARY OF THE INVENTION

In a first broad aspect, the present invention provides a heat exchanger including:

an outer housing;

a first means defining a first fluid flow path located in the housing, the first fluid flow path defining a plurality of turns and having an inlet and an outlet for entry and exit of fluid into the flow path to be heated or cooled:

a second means defining a second fluid flow path located within the housing adjacent to the first flow path, said second fluid flow path defining a plurality of turns and having inlet and outlet for a passage for hot or cold service media;

a sheath disposed between the first and second means;

a transfer medium disposed in the housing for transfer of heat between the first and second flow paths, using either a static or a flowing transfer medium;

preferably, a plurality of conductive baffles located between the outer housing and sheath and disposed between turns of the first fluid flow path; and preferably, a plurality of conductive baffles disposed between turns of the second fluid flow path.

In one preferred embodiment, the sheath may have a relatively high heat conductivity and be made of e.g. metal. The baffles may also be made of the same or a different material having a relatively high heat conductivity, such as metal.

In an alternative embodiment, the sheath and/or baffles may be made of a less conductive material such as a plastics material.

The sheath may be conductive and the baffles non-conductive.

By interposing a transfer medium between the two fluid flow paths rather than having one of the fluid flows as the medium itself, control over the cooling or heating of the fluid to be heated or cooled is possible. The fluid being cooled or heated and fluid transfer medium may be at different temperatures. The sheath and baffles help control the transfer of heat and improve the efficiency of the heat exchanger.

The heat transfer medium may be fluid, static or in motion, or a solid, depending on the application. Where the heat transfer medium is a fluid, any liquid or even a gaseous medium may be used but is most preferably a liquid medium. For the beverage dispensing application discussed above, a mixture of water and antifreeze, is particularly suitable but other fluids may be used to suit the application and the desired performance/inefficiency characteristics required.

Typically, the first and second fluid flow paths comprise helical coils with the second (inner) helical coil being of a relatively narrower diameter than the first (outer) helical coil and nested around the sheath which is located between the coils. The helical coils most typically have a circular cross section defining an interior and an exterior.

Where conductive baffles are inserted into the helix of each fluid flow path coil between turns of the helix, these confer thermal energy to the coils as well as defining a generally serpentine fluid flow path for the transfer media when the transfer media is in motion.

This results in heat transfer arising from both conduction and convection and considerably increases the efficiency of the system.

The housing is typically cylindrical having an annular cross-section and most typically comprises a metal or other material with a high coefficient of heat transfer. The beverage carried by the first coil is typically beer, although it may be a non alcoholic beverage or other liquid product. Typically, the second coil carries a gaseous refrigerant, typically a fluorocarbon such as R22 etc. or may be a liquid media such as hot water.

The second coil is in juxtaposition to the first coil and the sheath to optimise conductive heat transfer, between the outer coil and the inner coil. The baffles optimise convective heat transfer between the inner and outer coils where the heat transfer media is in motion.

BRIEF DESCRIPTION OF THE DRAWINGS

Specific embodiments of the invention will now be described by way of example only and with reference to the accompanying drawings in which.

DETAILED DESCRIPTION OF PREFERRED EMBODIMENTS

Figure 1:
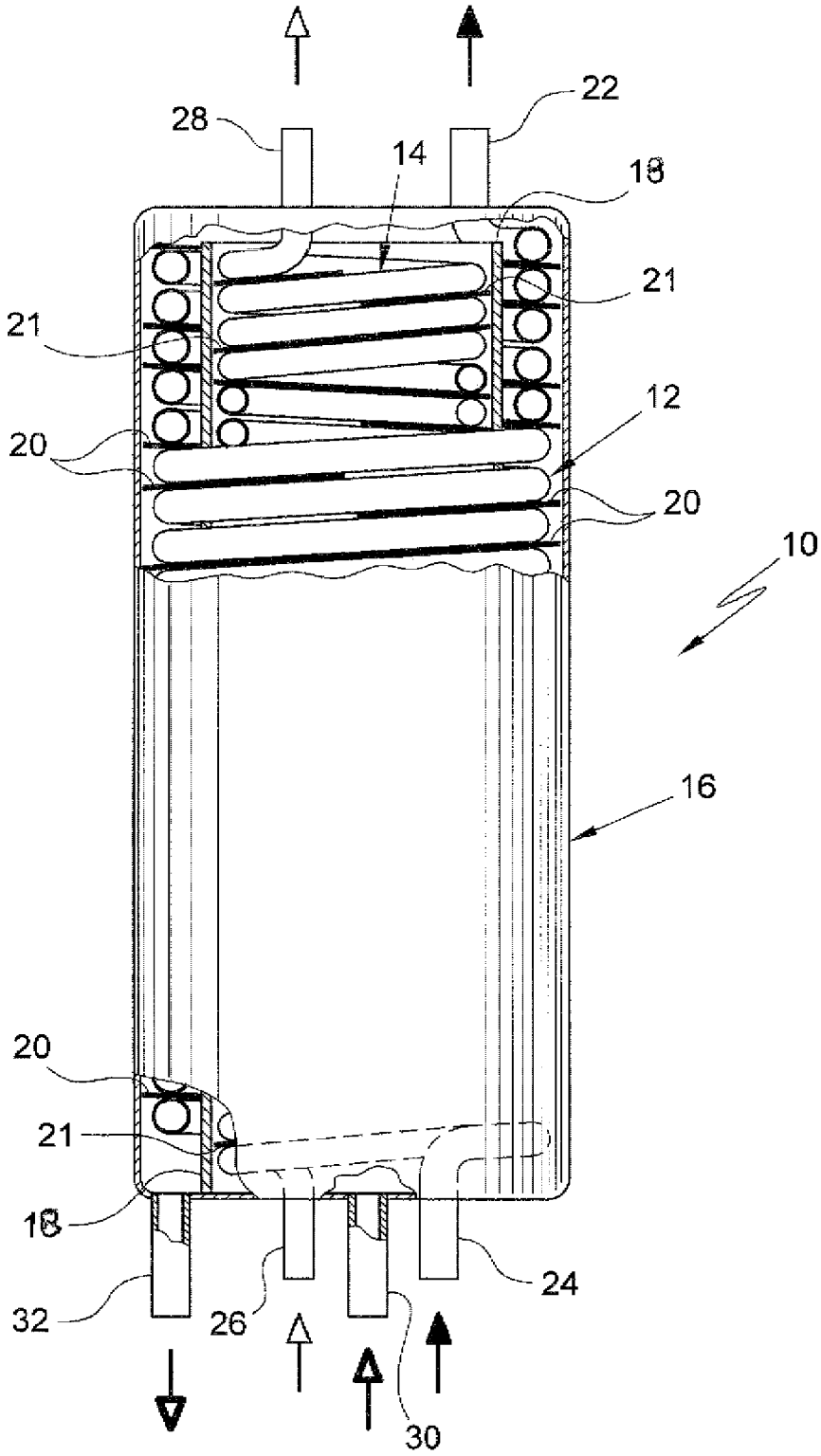
FIG. 1 is a perspective view of a heat exchanger embodying the present invention.
Figure 3:
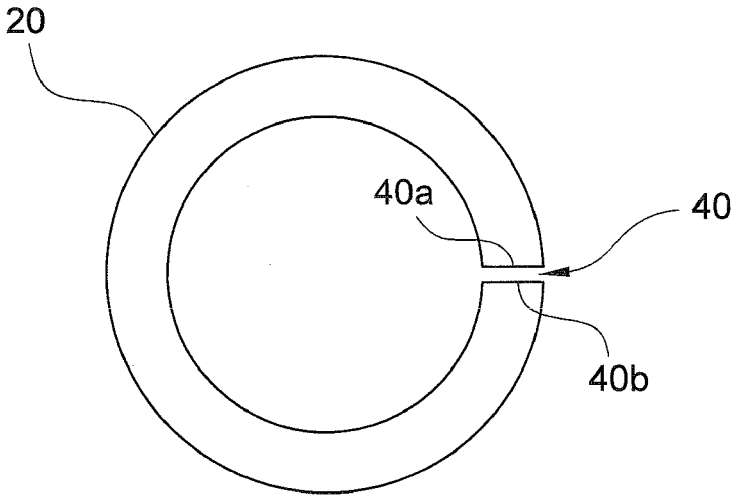
FIG. 3 shows a first annular baffle.
Figure 4:
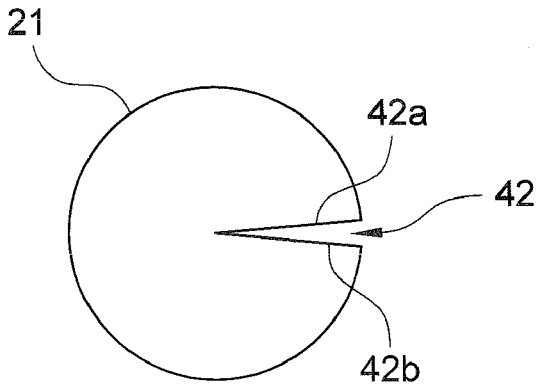
FIG. 4 shows a second baffle in the form of a circular plate.
Figure 5:
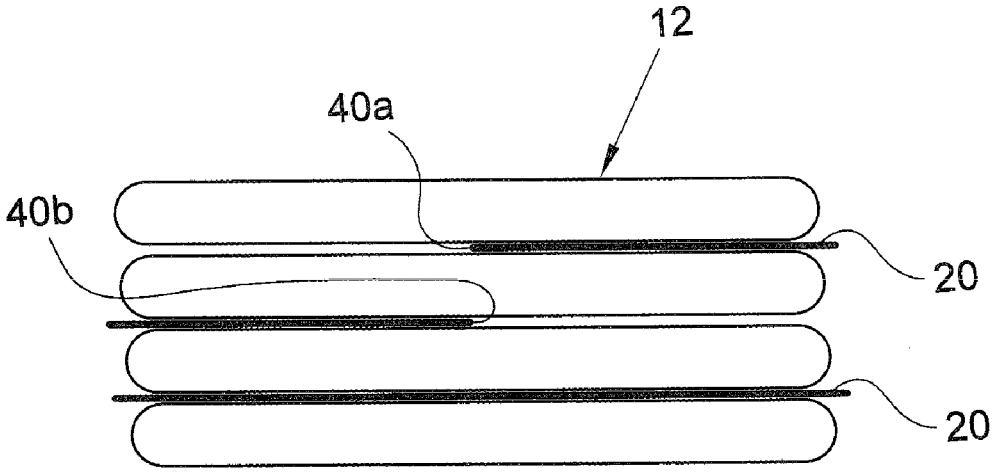
FIG. 5 is a detailed side view of the outer coil of the heat exchanger illustrating the arrangement of the first baffles.

Turning to the drawings, FIG. 1 shows a heat exchanger 10 comprising first (outer) and second (inner) helical coils 12 and 14 respectively located inside a housing 16 in the form of a hollow cylindrical housing having an annular cross section. a sheath 18 sits between coils 12 and 14. In the described embodiment the sheath is conductive being made of metal, typically stainless steel however, it is envisaged that for some applications, the sheath need not be conductive. First baffles 20 which in the described embodiment are metal and heat conductive, but which may not be in some applications, being e.g. plastic, are located between the turns of the coil 12 and extend between the conductive sheath 18 and the housing 16. Each baffle 20 (as is best seen in FIG. 3) is in the form of an annulus with the interior diameter of the annulus approximately equal to the external diameter of the sheath and the outer diameter approximately equal to the internal diameter of the housing. A radial slit 40 (shown exaggerated in width) extends across each annulus defining two ends 40*a* and 40*b*. When inserted between coils of the outer coil, with the slits offset by 180°, the baffles have the effect of making fluid travelling between the housing and the conductive sheath travel in a generally helical serpentine path, generally following the spiral of the helical coil 12, but reversing direction every 180° and effectively travelling the full length of the coil. As is best seen in FIG. 5 which shows a detail of the outer coil and first baffle 20 the ends 40*a* and 40*b* are separated by one turn of the coil and in the turn below the slit in the first baffle is offset by 180° and consequently not visible.

Figure 6:
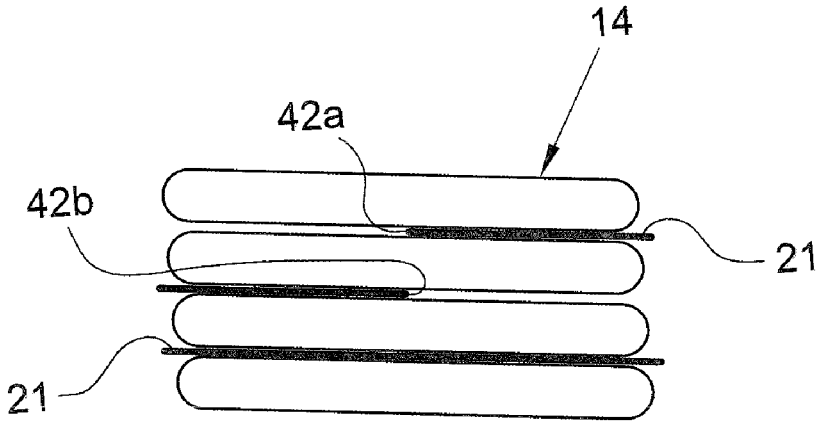
FIG. 6 is a detailed side view of the inner coil of the heat exchanger illustrating the arrangement of the second baffles.

A series of second conductive baffles 21 are also disposed between coils of the inner coil 14 inside the conductive sheath 18. These baffles 21 are generally circular and define a radial slit 42 through which fluid may flow and ends 40*a* and 40*b* where the slit is formed. The slits 42 of adjacent baffles are preferably at opposite sides of the coil 14 (i.e. at 180° relative to one another) forcing fluid travelling up or down the conductive sheath to follow a generally serpentine path. As is best seen in FIG. 6 which shows a detail of the exterior of the inner coil and second baffles 21 the ends 42*a* and 42*b* are separated by one turn of the coil and in the turn below the slit in the first baffle is offset by 180° and consequently not visible.

The conductive baffles 20 and 21 spaced between the helical coils 12 and 14 also impart turbulence to the fluid heat transfer media in motion for enhancing heat transfer between coils 12 and 14.

The outer coil 12 defines an exit point 22 at the top of the cylinder and an entry point 24 at the bottom of the cylinder, where fluids to be heated or cooled can enter and exit the coil 12. The entry and exit points can be reversed if desired.

Entry and exit points 26 and 28 respectively, for coolant or heating media typically expanded refrigerant gas in the second helical coil 14, are located at the top and base of the heat exchanger 10.

The helical coils 12 and 14, the vessel 16 baffles and sheath may be made of any suitable material. Typically stainless will be used for the helical coils baffles and sheath particularly when used for beverage products such as beer and soft drinks. However the sheath and baffles may be made of any suitable conductive material.

Figure 2:
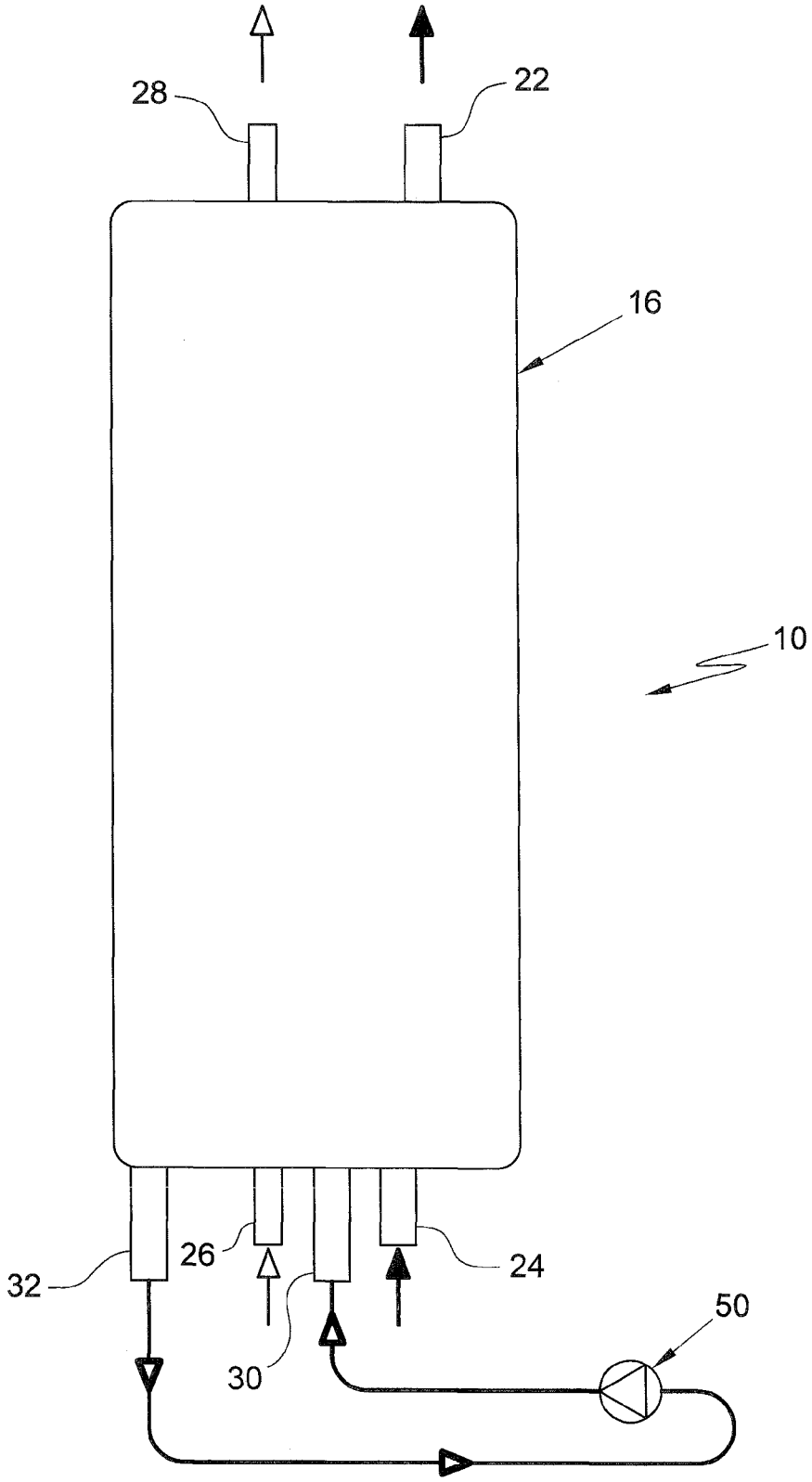
FIG. 2 is a schematic arrangement of a heat exchanger with a heat transfer media in motion.

FIG. 2 illustrates a pump 50 for pumping the fluid transfer medium around the coils 12, 14 in the housing. Fluid heat transfer media when in motion, enters and exits at 30 and 32 respectively located at base of heat exchanger 10.

The diameter of the tubes, the helical coils, the number of baffles, the lengths of the coil and the size of the housing and sheath can be varied to suit the particularly heat exchange requirements of the heat exchange system.

The inner or second helical coil 14 is sized to enable it to be inserted within the outer helical coil 12 with a gap between the inner surface of the helical coil and the outer surface of the helical coil 14 sufficient to enable the insertion of the conductive sheath 18. The gap can be varied to suit the particular applications. In the illustrated example the gap is about 5 mm.

The housing 16 is filled with a heat transfer fluid which may be static or in motion which remains in liquid form irrespective of the temperature of the expanded refrigerant entering and exiting at 26 and 28. The entire vessel containing the heat exchanger 10 may be enclosed in an insulated box.

The use of the heat exchanger 10 for dispensing beer in a small dispensing and chilling installation in a restaurant or the like will now be described, although it will be appreciated that the heat exchanger 10 may be used in many other applications.

The inlet 24 is connected to a keg or beer or the like and a small pump or gas pressure is provided for transferring beer from the keg through the coil 12 to outlet 22 and the tap.

The second coil 14 is connected to a refrigeration unit. The refrigerant gas for cooling the heat exchanger typically passes through a TX valve or fixed orifice, to expand it prior to entry into the coil 14 via entry 26 and exits the coil via the exit 28. For cooling beer, R404 or an equivalent refrigerant is the preferred refrigerant, although other refrigerants such as R134A, R22 could be used. The expansion of the refrigerant inside a coil rather than say in the vessel 16 itself, ensures that the refrigerant travels at a constant velocity and makes the heat exchanger much easier to control. The refrigerant will typically be at a temperature of around −4° C. The spacing of the refrigerant coil 14 from the coil containing beverage 12 reduces the efficiency of the heat transfer from the beverage to the refrigerant and lessens the likelihood of the beverage freezing within the heat exchanger, particularly when the heat exchanger is used infrequently, as is likely in a restaurant.

A number of heat exchange units as shown in FIG. 1, could be assembled together and share a common refrigerant line. A plurality of such units would allow for a multiple fluid steams of different fluids to heated and cooled to differing temperatures and cooled simultaneously such as may be required in an application such as a hotel, bar or club, Again, the diameter of the coils and the distance between the first and second coils could be varied as could their length, with the requirement being that the overall heat transfer coefficient between the refrigerant gas and the beverage, be increased or decreased based on specific heat exchange requirements.

Depending on the application, the diameter of the coils and the distance between the first and second coils, and the nature of the heat transfer medium whether static or in motion in terms of its heat transfer coefficient, and nature (fluid, or solid) could be varied to provide heat exchangers having particular characteristics to suit particular applications.

Other uses envisaged for heat exchangers incorporating solid heat transfer media embodying the present invention include in cooling water or other beverages where cross-contamination with either cooling fluid or heat transfer media has health implications and is to be avoided.

Similarly steam or hot water can be introduced into the same flow path as the refrigerant gases for all heating applications where heated fluids are to be generated.

Another suitable application for the heat exchanger embodying the invention is for laboratory use where cooled liquids are required for condensing vapours of exchanging to other fluid or gaseous media.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A heat exchanger for cooling beverages including:

an outer housing;

a first means defining a first fluid flow path located in the housing, the first fluid flow path defining a plurality of turns and having an inlet and an outlet for entry and exit of fluid into the flow path to be heated or cooled:

a second means defining a second fluid flow path located within the housing adjacent to the first flow path, said second fluid flow path defining a plurality of turns and having inlet and outlet for a passage for hot or cold service media;

a sheath disposed between the first and second fluid flow paths;

a transfer medium disposed in the housing for transfer of heat between the first and second flow paths, using a flowing transfer medium;

a plurality of first baffles located between the outer housing and the sheath and disposed between the turns of the first fluid flow path; and a plurality of second baffles disposed between the turns of the second fluid flow path wherein the first baffles located between the outer housing and the sheath comprise an annulus having an element selected from the group consisting of a discontinuity and a slit extending between an interior and an exterior of the annulus and are a close fit between an interior of the housing and an exterior of the sheath and wherein the second baffles located inside the sheath are circular plates having a radial slit extending from a circumference of the circular plate substantially to its centre and are a close fit to an interior of the sheath.

2. A heat exchanger as claimed in claim 1 wherein the sheath is made from a material having a relatively high heat conductivity.

3. A heat exchanger as claimed in claim 2 wherein the first and second baffles are made from a material having a relatively high heat conductivity.

4. A heat exchanger as claimed in claim 1 wherein the sheath is made from a material having a relatively low heat conductivity.

5. A heat exchanger as claimed in claim 1 wherein the first and second baffles are made from a material having a relatively low heat conductivity.

6. A heat exchanger as claimed in claim 1 wherein the first and second fluid flow paths comprise helical coils with the second (inner) helical coil being of a relatively narrower diameter than the first (outer) helical coil and nested around the sheath which is located between the coils.

7. A heat exchanger as claimed in claim 6 wherein the helical coils have a circular cross section defining an interior and an exterior.

8. A heat exchanger as claimed in claim 1 wherein the housing is cylindrical having an annular cross-section and comprises a metal or other material with a high coefficient of heat transfer.

9. A heat exchanger as claimed in claim 1 wherein the slits in adjacent annuli are offset to force fluid travelling between the housing and the sheath to adopt a serpentine flow-path.

10. A heat exchanger as claimed in claim 9 wherein the offset is about 180°.

11. A heat exchanger as claimed in claim 1 wherein the slits in adjacent circular plates are offset to force fluid travelling through the sheath to adopt a generally serpentine flow-path.

12. A heat exchanger as claimed in claim 11 wherein the offset is about 180°.

13. A heat exchanger for cooling beverages including:

an outer housing;

a first means defining a first fluid flow path located in the housing, the first fluid flow path being formed as a first helical coil and defining a plurality of turns and having an inlet and an outlet for entry and exit of fluid into the flow path to be heated or cooled:

a second means defining a second fluid flow path located within the housing adjacent to the first flow path, said second fluid flow path being formed as a second helical coil and defining a plurality of turns and having inlet and outlet for a passage for hot or cold service media;

a sheath made from metal disposed between the first and second means;

a transfer medium disposed in the housing for transfer of heat between the first and second flow paths, using a flowing transfer medium;

a plurality of first baffles located between the outer housing and the sheath and disposed between the turns of the first fluid flow path wherein the first baffles located between the outer housing and the sheath comprise an annulus having an element selected from the group consisting of a discontinuity and a slit extending between an interior and an exterior of the annulus and are a close fit between an interior of the housing and an exterior of the sheath; and a plurality of second baffles disposed between the turns of the second fluid flow path, wherein the second baffles located inside the sheath are circular plates having a radial slit extending from a circumference of the circular plate substantially to its centre and are a close fit to an interior of the sheath.

* * * * *